United States Patent [19]

Ayer et al.

[11] Patent Number: 4,995,838

[45] **Date of Patent: * Feb. 26, 1991**

[54] ELECTRICAL TERMINAL AND METHOD OF MAKING SAME

[75] Inventors: Kenneth N. Ayer, Hummelstown; James P. Scholz, New Cumberland, both of Pa.

[73] Assignee: AMP Incorporated, Harrisburg, Pa.

[ * ] Notice: The portion of the term of this patent subsequent to Aug. 1, 2006 has been disclaimed.

[21] Appl. No.: 385,643

[22] Filed: Jul. 27, 1989

Related U.S. Application Data

[63] Continuation-in-part of Ser. No. 277,094, Nov. 29, 1988, Pat. No. 4,852,252, and a continuation-in-part of Ser. No. 375,787, Jun. 30, 1989.

[51] Int. Cl.[5] ..... H01R 43/02; H01R 4/02

[52] U.S. Cl. ..... 439/874; 29/860; 29/447; 174/DIG. 8; 174/84 R; 174/88 C; 264/230

[58] Field of Search ..... 29/447, 857, 860; 174/35 C, 36, 84 R, 88 R, 88 C, DIG. 8; 264/230; 439/874

[56] References Cited

U.S. PATENT DOCUMENTS

| | | | |
|---|---|---|---|
| 2,759,161 | 8/1956 | Berg | 339/97 |
| 3,360,631 | 12/1967 | Hess | 29/447 |
| 3,396,460 | 8/1968 | Wetmore | 29/629 |
| 3,525,799 | 8/1970 | Ellis et al. | 174/84 |
| 3,601,783 | 8/1971 | Loose | 339/223 R |
| 3,708,611 | 1/1973 | Dinger | 439/877 |
| 3,721,749 | 3/1973 | Clabburn | 174/88 R |
| 3,930,606 | 1/1976 | Dewdney | 228/232 |
| 3,945,114 | 3/1976 | Siden et al. | 29/628 |
| 4,251,305 | 2/1981 | Becker et al. | 156/86 |
| 4,256,945 | 3/1981 | Carter et al. | 219/10.75 |
| 4,292,099 | 9/1981 | Dinger | 174/84 R |
| 4,341,921 | 7/1982 | Simpson | 174/84 R |
| 4,436,565 | 3/1984 | Weitzel et al. | 174/88 C |
| 4,460,820 | 7/1984 | Matsumoto et al. | 174/DIG. 8 |
| 4,464,540 | 8/1984 | Reeder | 174/35 C |
| 4,504,699 | 3/1985 | Dones et al. | 174/84 R |
| 4,595,724 | 6/1986 | Koblitz | 524/409 |
| 4,623,401 | 11/1986 | Derbyshire et al. | 148/13 |
| 4,626,767 | 12/1986 | Clappier et al. | 323/280 |
| 4,659,912 | 4/1987 | Derbyshire | 219/535 |
| 4,695,713 | 9/1987 | Krumme | 219/553 |
| 4,696,841 | 9/1987 | Vidakovits | 428/36 |
| 4,701,587 | 10/1987 | Carter et al. | 219/10.75 |
| 4,717,814 | 1/1988 | Krumme | 219/553 |
| 4,722,471 | 2/1988 | Gray et al. | 228/265 |
| 4,745,264 | 5/1988 | Carter | 219/553 |
| 4,752,673 | 6/1988 | Krumme | 219/553 |
| 4,795,870 | 1/1989 | Krumme et al. | 219/9.5 |
| 4,852,252 | 8/1989 | Ayer | 29/860 |

FOREIGN PATENT DOCUMENTS 0241597 10/1987 European Pat. Off. .

*Primary Examiner*—Gary F. Paumen
*Attorney, Agent, or Firm*—Anton P. Ness

[57] ABSTRACT

A plurality of terminals already disposed in a housing of an electrical connector, include solder tails extending rearwardly from the housing each of which has a thin foil-like substrate having a layer of magnetic material bonded intimately onto an outer surface thereof, so that respective wire ends may be placed therealong with solder preforms within lengths of heat recoverable tubing may be placed therearound and a high frequency current induced in the magnetic layer of the substrate which then generates thermal energy sufficient to melt the solder and shrink the tubing forming terminations between the wires and the terminals and simultanously sealing the terminations. The magnetic material of the substrate may be nickel-iron alloy, which may comprise the foil or which may be clad to a brass layer of the foil, which is then soldered to a brass solder tail layer. The thermal energy is generated in an amount necessary to raise the temperature of the magnetic layer to its Curie temperature for the given frequency used and maintain the temperature. Each terminal thus includes an integral self-regulating thermal energy source, and the thermal energy radiates outwardly from the solder tails and is thus localized at the termination sites. The heating necessary to melt the solder is thus controlled in temperature and in location, substantially unaffecting the remainder of the connector, in an energy efficient process.

6 Claims, 5 Drawing Sheets

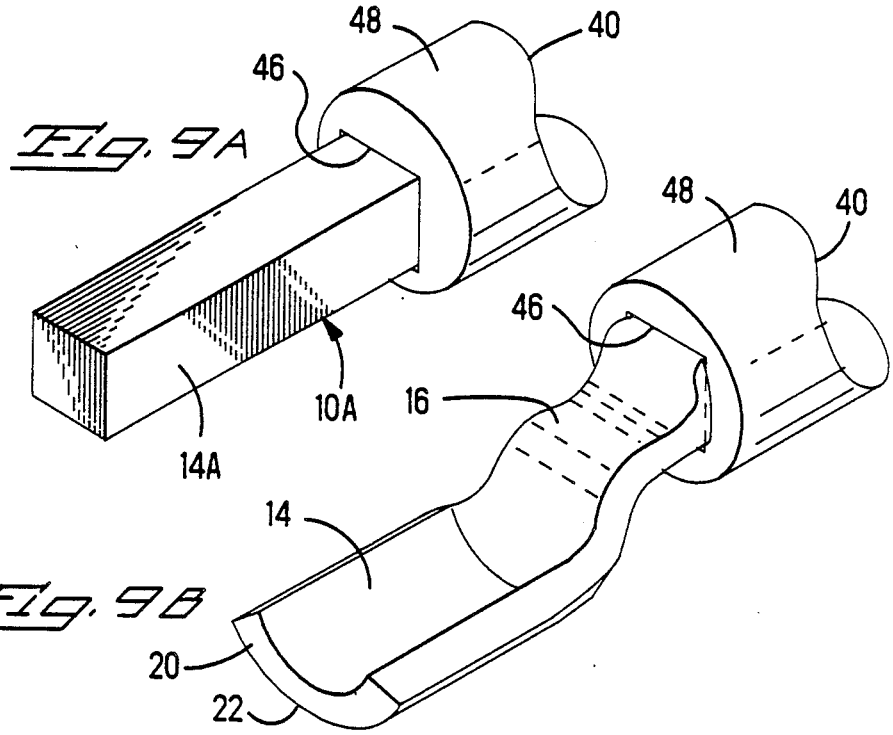
Fig. 9A
Fig. 9B
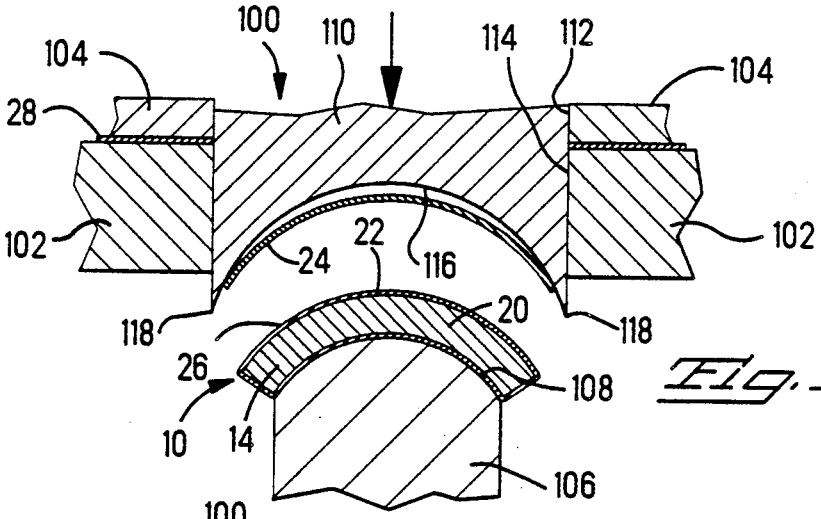
Fig. 10A
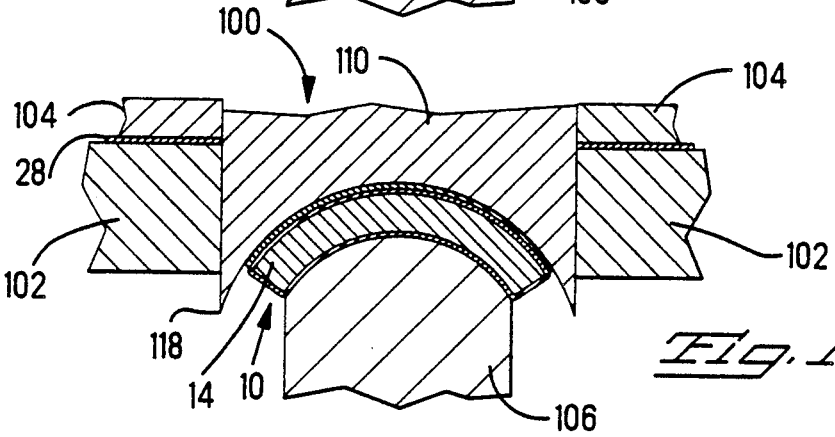
Fig. 10B

ELECTRICAL TERMINAL AND METHOD OF MAKING SAME

REFERENCE TO RELATED APPLICATION

This is a Continuation-in-Part of U.S. patent application Ser. No. 07/277,094 filed Nov. 29, 1988, now U.S. Pat. No. 4,852,252, and a Continuation-in-Part of U.S. patent application Ser. No. 07/375,787 filed June 30, 1989.

FIELD OF THE INVENTION

The present invention relates to the field of electrical connectors and more particularly to an electrical terminal for termination to an electrical conductor.

BACKGROUND OF THE INVENTION

Electrical connectors are known which have a plurality of terminals disposed in a dielectric housing and which are to be terminated to a respective plurality of conductor wires. In one such connector the terminals are disposed in a single row within a housing molded thereover and extend rearwardly from the housing, to conclude in termination sections comprising shallow channels termed solder tails The housing may include cylindrical portions extending rearwardly to surround the terminals forwardly of the solder tails. When the conductor wires are prepared to be terminated to the solder tails, individual sleeve-like solder preforms encased within respective longer sleeves of heat recoverable or heat shrink tubing are placed over the rearwardly extending terminal portions so that the solder preforms surround the solder tails, or a strip of such units appropriately spaced apart; the stripped wire ends are then inserted into the heat recoverable tubing sleeves and into the solder preforms surrounding the solder tails; the entire assembly is then placed in a conventional thermal energy source and heated by convection, with the heat energy penetrating through the heat recoverable tubing to melt the solder which then flows around the stripped wire ends within the solder tails and upon cooling forms respective solder joints joining the conductor wires to the terminals; and simultaneously the heat recoverable tubing is heated above a threshold temperature at which the tubing shrinks in diameter until it lies adjacent and tightly against surfaces of the solder tails and the wire termination therewithin, a portion of the insulated conductor wire extending rearwardly therefrom, and a portion of the terminal extending forwardly therefrom to the rearward housing surface, sealing the exposed metal surfaces. Apparatus for wire and sleeve handling with respect to such connector is known such as from U.S. Pat. No 3,945,114. Within forward and rearward ends of the tubing are located short sleeve-like preforms of fusible sealant material which will shrink and also tackify upon heating to bond and seal to the insulation of the wire, and to the cylindrical housing portions therewithin and to bond to the surrounding heat recoverable tubing. Examples of such assemblies of heat recoverable tubing lengths with solder preforms and sealant preforms therein are disclosed in U.S. Pat. Nos. 3,525,799; 4,341,921 and 4,595,724.

Conventional thermal energy sources achieve a temperature in excess of a control temperature, which is chosen to be somewhat above the ideal temperature at which a particular solder material melts in order to compensate for less than ideal thermal energy transfer.

Several disadvantages attend such a thermal energy delivery method: portions of the connector other than connection sites are subjected to substantial heat which may be detrimental to the connector material; the thermal energy applied to connector portions other than the connection sites is wasted; components possibly may be damaged because of general overheating, and some sites may achieve a temperature much higher than necessary in order to assure that other sites achieve a sufficient solder melting temperature; the thermal energy source either requires a long warm-up period which is wasteful of time, or remains heated at its steady state temperature which is wasteful of energy; and maintenance of a continuous and accurate control over temperature and time is an ideal desire requiring a diligence and responsive apparatus not consistently met or found in practice. Another disadvantage is that heat recoverable tubing which is initially made transparent and is desired to remain transparent to allow visual inspection of the solder joint after termination, commonly receives enough excess thermal energy to opaquify, at least obscuring the solder joint therewithin.

It is desired to obtain solder joints without heating all portions of the connector.

It is desired to consistently obtain assured solder joints in a multiterminal connector having prehoused terminals.

It is known in the prior art to utilize a self-regulating temperature source which when energized by a constant amplitude, high frequency alternating current passing therethrough, generates thermal energy and achieves a resulting constant temperature. Such a temperature can be selected to be just higher than the ideal temperature at which solder melts. The self-regulating temperature source is disclosed in U.S. Pat. Nos. 4,256,945; 4,623,401; 4,659,912; 4,695,713; 4,701,587; 4,717,814; 4,745,264 and European Pat. Publication No. 0241,597, which are expressly incorporated herein by reference. The self-regulating temperature source employs a substrate of copper or copper alloy or other conductive material of low electrical resistivity, negliqible magnetic permeability and high thermal conductivity; deposited on one surface thereof is a thin layer of thermally conductive magnetic material such as iron, nickel or a nickel-iron alloy having a much higher electrical resistance and magnetic permeability than the substrate material.

When a radio frequency current for example is passed through such a two-layer structure, the current initially is concentrated in the thin high resistance magnetic material layer which causes heating; when the temperature in the magnetic material layer reaches its Curie temperature, it is known that the magnetic permeability of the layer decreases dramatically; the current density profile then expands into the non-magnetic substrate of low resistivity. The thermal energy is then transmitted by conduction to adjacent structure such as wires and solder, which act as thermal sinks; since the temperature at thermal sink locations does not rise to the magnetic material's Curie temperature as quickly as at non-sink locations, the current remains concentrated in those portions of the magnetic material layer adjacent the thermal sink locations and is distributed in the low resistance substrate at non-sink locations. It is known that for a given frequency the self-regulating temperature source achieves and maintains a certain maximum temperature dependent on the particular magnetic material.

The conductive substrate can be copper having a magnetic permeability of about one and a resistivity of about 1.72 micro-ohms per centimeter. The magnetic material may be for example a clad coating of nickel-iron alloy such as Alloy No 42 (forty-two percent nickel, fifty-eight percent iron) or Alloy No. 42-6 (forty-two percent nickel, fifty-two percent iron, six percent chromium). Typical magnetic permeabilities for the magnetic layer range from fifty to about one thousand, and electrical resistivities normally range from twenty to ninety micro-ohms per centimeter as compared to 1.72 for copper; the magnetic material layer can have a Curie temperature selected to be from the range of between 200° C. to 500° C. The thickness of the magnetic material layer is typically one skin depth; the skin depth is proportional to the square root of the resistivity of the magnetic material, and is inversely proportional to the square root of the product of the magnetic permeability of the magnetic material and the frequency of the alternating current passing through the two-layer structure.

SUMMARY OF THE INVENTION

The present invention employs self-regulating temperature source technology to terminate a conductor such as a wire to a respective terminal of an electrical connector. A terminal subassembly is formed by placing a plurality of terminals in a dielectric housing, such as by molding dielectric material around body sections of the terminals, and contact sections of the terminals are exposed along a mating face of the housing for eventual mating with corresponding contact sections of another connector. Termination sections of the terminals extend rearwardly from the housing to be terminated to individual conductor wires, and comprise preferably shallow channels. The terminals may be made of a copper alloy such as brass, phosphor bronze or beryllium copper for example. On the outwardly facing surface of the termination section is secured intimately thereto a thin layer of foil at least including an outwardly facing layer of magnetic material having high electrical resistance and high magnetic permeability; the presence of such a thin magnetic layer converts the termination section into an individual self-regulating temperature source integral with the terminal.

The thin layer of foil is formed to have an appropriate outline and shape and which is then soldered to the solder tail on the outer surface thereof. The solder tail may previously have been completely coated with tin-antimony or tin-lead solder. The solder-coated solder tail is then placed in an apparatus having tooling which holds the foil against the solder-coated outer surface and simultaneously heats the foil against the solder-coated solder tail outer surface until the solder melts, and the tooling is then removed from the solder tail to which the foil is now joined when the solder material solidifies. The tooling may also shear the shape of the foil from a sheet thereof in a step which then urges the foil shape against the solder tail in a manner which forces the foil shape to conform to the solder tail surface. The surface of the foil to become the outwardly facing surface of the solder tail contains the magnetic material and may be coated with a solder resist material to facilitate the eventual wire termination process Preformed short lengths of solder are placed around the termination sections, with lengths of heat recoverable tubing around the solder preforms and extending forwardly over cylindrical housing flanges covering the terminals forwardly of the terminating sections, to the rear surface of the housing, and rearwardly a distance beyond the ends of the termination sections Stripped ends of conductor wires are placed along the respective channels and within the solder preforms, and a portion of the insulated wire extends into the rearward end of the heat recoverable tubing lengths Preforms of sealant material may be disposed within the forward and rearward tubing sections to shrink, tackify and bond to the housing flanges and wire insulation respectively, and bond to the surrounding portions of heat recoverable tubing.

The assembly is then placed within appropriate tooling having an inductance coil surrounding the plurality of termination sections and transverse to the assembly, and the coil is energized to produce a selected constant amplitude high frequency alternating current. The current induces corresponding currents in the plurality of termination sections producing local thermal energy which rises to a certain temperature selected to be slightly higher than needed to melt the solder preforms, thereby melting the solder which forms solder joints between the wires and the termination sections. The thermal energy also radiates outwardly and is transmitted to and begins to shrink and tackify the sealant preforms and to shrink the surrounding heat recoverable tubing which reduces to conform to the outer surfaces of the structure therewithin including the insulated wire portion, the termination sections including the terminations, the shrunken sealant preforms and the housing flanges. The terminations of the terminals to the wires are completed and the terminations and all exposed metal is sealed, completing the connector, which then may be placed within a metal shell for physical protection.

It is an objective to provide a connector having a plurality of discrete terminals to be terminated to conductor wires and then sealed in a simple, assured, efficient and economical process.

It is another objective to solder the wires and seal the terminations simultaneously.

It is a further objective to solder the wires to the terminals by assuredly achieving a certain selected temperature at all termination sites, and only at the termination sites.

It is yet another objective to provide the thermal energy from a source within the solder preform, with the energy then radiating outwardly to sealant preforms and transparent tubing therearound after the solder melts, thus minimizing the amount of excess heat received by the tubing, enhancing its ability to remain transparent, and thereby allow visual inspection of the solder joint.

It is still another objective to provide a method for applying thermal energy sources to the terminals themselves prior to wire termination.

An example of the present invention will now be described with reference to the accompanying drawings.

BRIEF DESCRIPTION OF THE DRAWINGS

FIG. 5 illustrates a soldered and sealed termination;

FIG. 6 illustrates thin layers of foil containing magnetic material exploded from respective solder tails;

FIG. 7 is a cross-section of a solder tail taken along lines 7—7 of FIG. 6 to show the low resistance metal layer, a surrounding layer of tin-lead solder, and the foil containing magnetic material which define the self-regulating temperature source integral with the terminal;

FIGURES 8, 9A and 9B illustrate a terminal formed from a square post to have a socket contact section at its forward end, and then after insertion through a housing passageway is formed at its rearward end to have a solder tail to which the foil is soldered; and FIGS. 10A and 10B illustrate a method of soldering the foil to the solder tail, with tooling which punches the foil shape from a foil sheet and applies it against the solder tail and heats and melts the solder layer between the foil and the solder tail.

DETAILED DESCRIPTION OF THE PREFERRED EMBODIMENT

Figure 1:
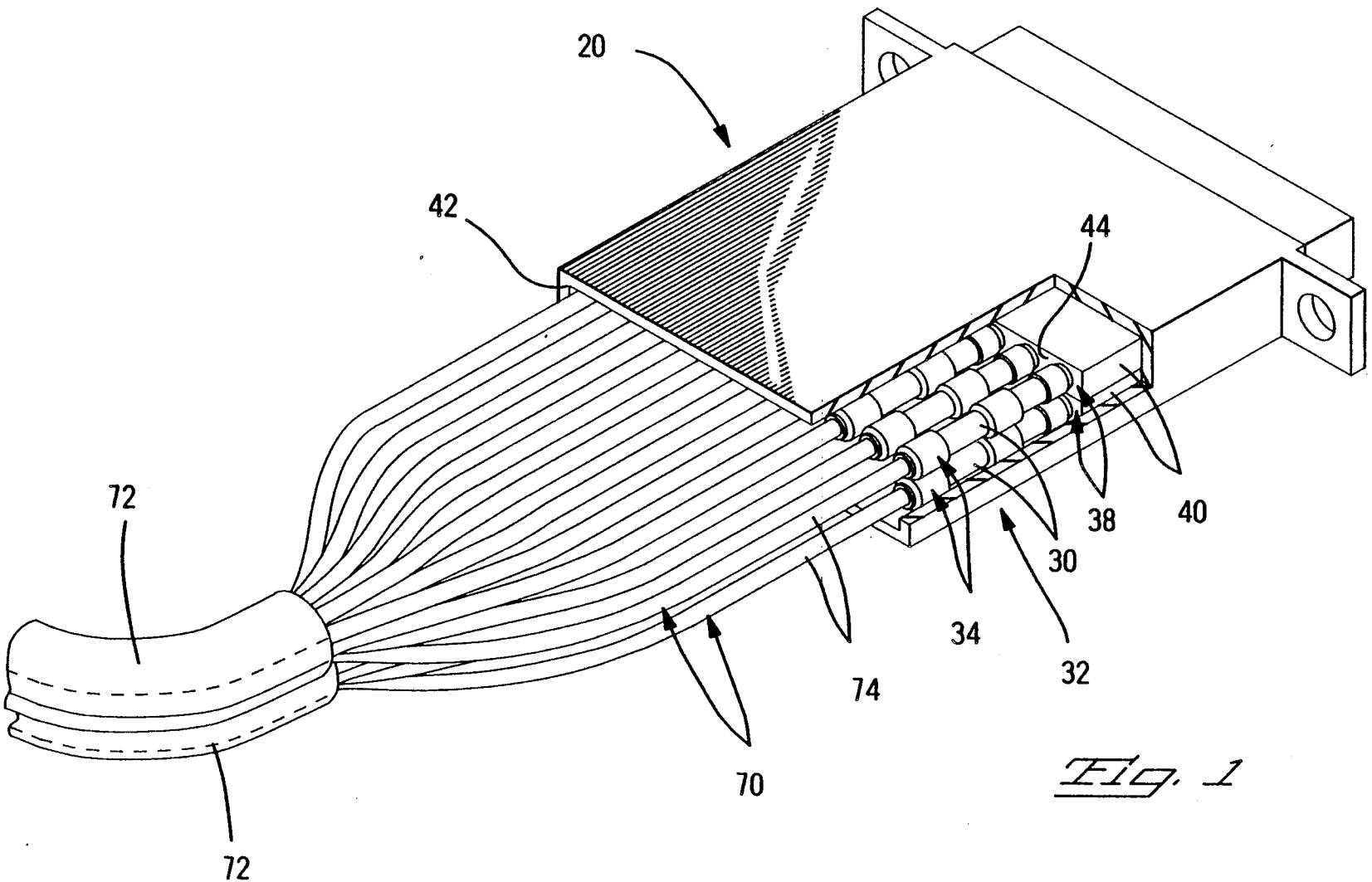
FIG. 1 is a perspective view of a connector with which the present invention is used.
Figure 2:
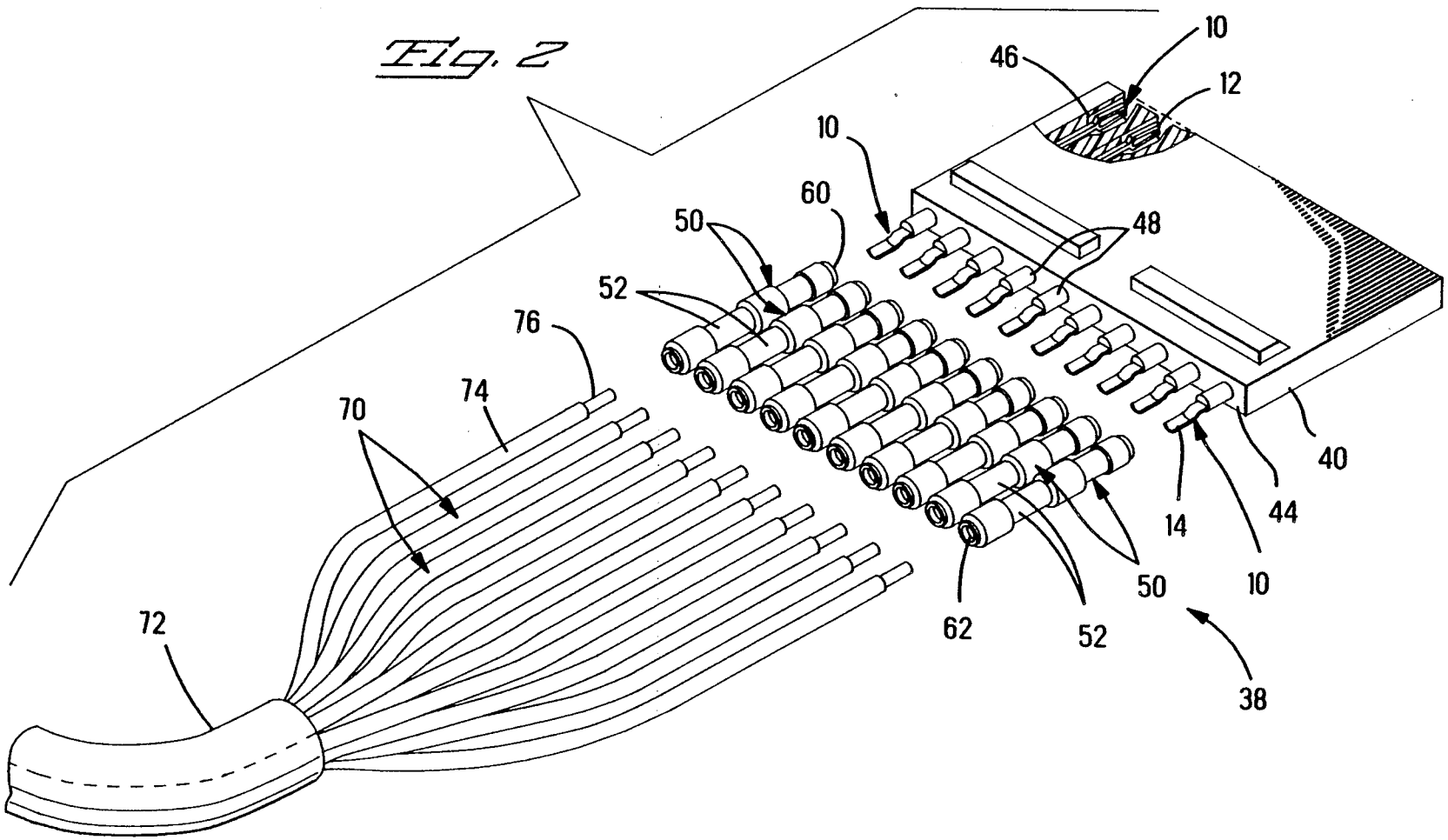
FIG. 2 is similar to FIG. 1 with a terminal subassembly of the connector exploded from the conductor wires, showing lengths of heat recoverable tubing containing solder preforms used in the assembly of the connector.

FIG. 1 shows a connector 20 having a plurality of terminals 10 (FIG. 2) secured within a pair of dielectric housings 40 within a shell 42 and terminated at terminations 30 to a respective plurality of conductor wires 70 within a termination region 32 rearwardly of wire face 44 of housings 40. Terminals 10 are disposed along respective passageways 46 of housings 40 and include at forward ends thereof respective socket contact sections 12 (FIG. 2) which are shaped like tuning-forks having pairs of tines oriented in respective vertical planes. Socket contact sections 12 extend forwardly in respective forward sections of passageways 46 to mating faces of housings 40 and are adapted to mate with post contact sections of corresponding electrical contacts of a mating connector (not shown). Conductor wires 70 have insulation material therearound and may be bundled within an outer jacket 72. The termination region 32 includes individual seals 34 formed around terminations 30 and extending from wire face 44 of each housing 40 to insulated end portions 74 of wires 70. The terminals 10 are shown disposed in single rows for a low profile module 38 for a miniature rectangular connector, although the present invention may be used with other styles of connectors and other terminal arrangements. The terminals may also have blade or pin or post contact sections.

Referring to FIGS. 2 to 5 each terminal 10 includes a terminating section 14 disposed at the end of an intermediate section 16 extending generally in a horizontal plane rearwardly from a body section secured within housing 40 Preferably intermediate section 16 is disposed partly along and within a rearward section of passageway 46 within a respective cylindrical housing portion or flange 48 extending rearwardly from wire face 44, with flange 48 to facilitate eventual process steps and to assure appropriate sealing and optionally including annular ribs or other projections (not shown) to assist eventual sealing. Terminating section 14 has a shallow channel shape and is conventionally termed a solder tail for eventual placement thereinto and soldering therewithin of a stripped end portion 76 of a conductor wire 70. Along outwardly facing surface 22 of each solder tail 14 is intimately secured thereto a thin substrate 24 at least containing magnetic material to define along with the metal layer 20 of solder tail 14 a terminal-integral self-regulating temperature source, shown in FIGS. 5 and 6. Sleeve assembly 50 associated with solder tail 14 is shown in detail in FIG. 3 and comprises a length of heat recoverable tubing 52, which includes centrally therewithin a solder preform 54 and preferably includes two sealant preforms 56, 58 also therewithin at the ends thereof.

Solder preform 54 preferably is formed in a sleeve shape of short length large enough to be placed over and around a respective solder tail 14. Length 52 of preferably transparent heat recoverable tubing is formed to be placed over solder preform 54 and be sufficiently long to extend over flange 48 from wire face 44, over solder tail 14, and over insulated wire end portion 76. Solder preform 54 is placed within tubing 52 at an axial location appropriate so that when the sleeve assemblies 50 are placed over the rearwardly extending terminal portions the solder preform 54 will surround the solder tail 14. Sealant preforms 56, 58 are short sleeve-like lengths of sealant material axially spaced to be disposed over the end of flange 48 and the insulated wire end portion 76. The plurality of sleeve assemblies 50 for the plurality of solder tails 14 may be joined if desired by a strip of adhesive tape or the like to form a single entity for convenient handling as is conventionally known, with sleeve assemblies 50 appropriately spaced apart to correspond to the spacing of the terminals 10 secured in housing 40.

Solder preform 54 and sealant preforms 56, 58 are secured within tubing 52 such as by being force-fit therewithin, or by tubing 52 being partially shrunk or reduced in diameter therearound. Solder preform 54 may be made of tin-lead solder including solder flux therein, such as for example Sn 63 RMA meltable at a temperature of about 183° C. or Sb-5 meltable at about 240° C.; sealant preforms 56, 58 may comprise for example a homogeneous mixture of polyvinylidene fluoride, methacrylate polymer and antimony oxide and shrink in diameter at a nominal temperature selected to be about 190° C.; and tubing 52 is preferably transparent and may be of cross-linked polyvinylidene fluoride and have a nominal shrinking temperature of about 175° C. Generally it would be preferable to select a solder tail to achieve a temperature of about 50° C. to 75° C. above the solder melting point.

FIGS. 2 to 5 illustrate the method of terminating the wire ends and solder tails of housing 40 and sealing the terminations. Each stripped wire end 76 is terminated to a respective solder tail 14 of a terminal 10, forming a termination 30 and sealed therearound by seal 34. Sleeve assembly 50 is placed over a respective solder tail 14 until leading end 60 abuts wire face 44 of housing 40, so that sealant preform 56 surrounds flange 48 and solder preform 54 surrounds solder tail 14. Stripped conductor wire 76 is inserted into trailing end 62 of sleeve assembly 50 until located such as by visual observation through transparent tubing 52 completely along solder tail 14 within solder preform 54 and insulated end portion 74 is disposed within sealant preform 58.

Figures 3, 4:
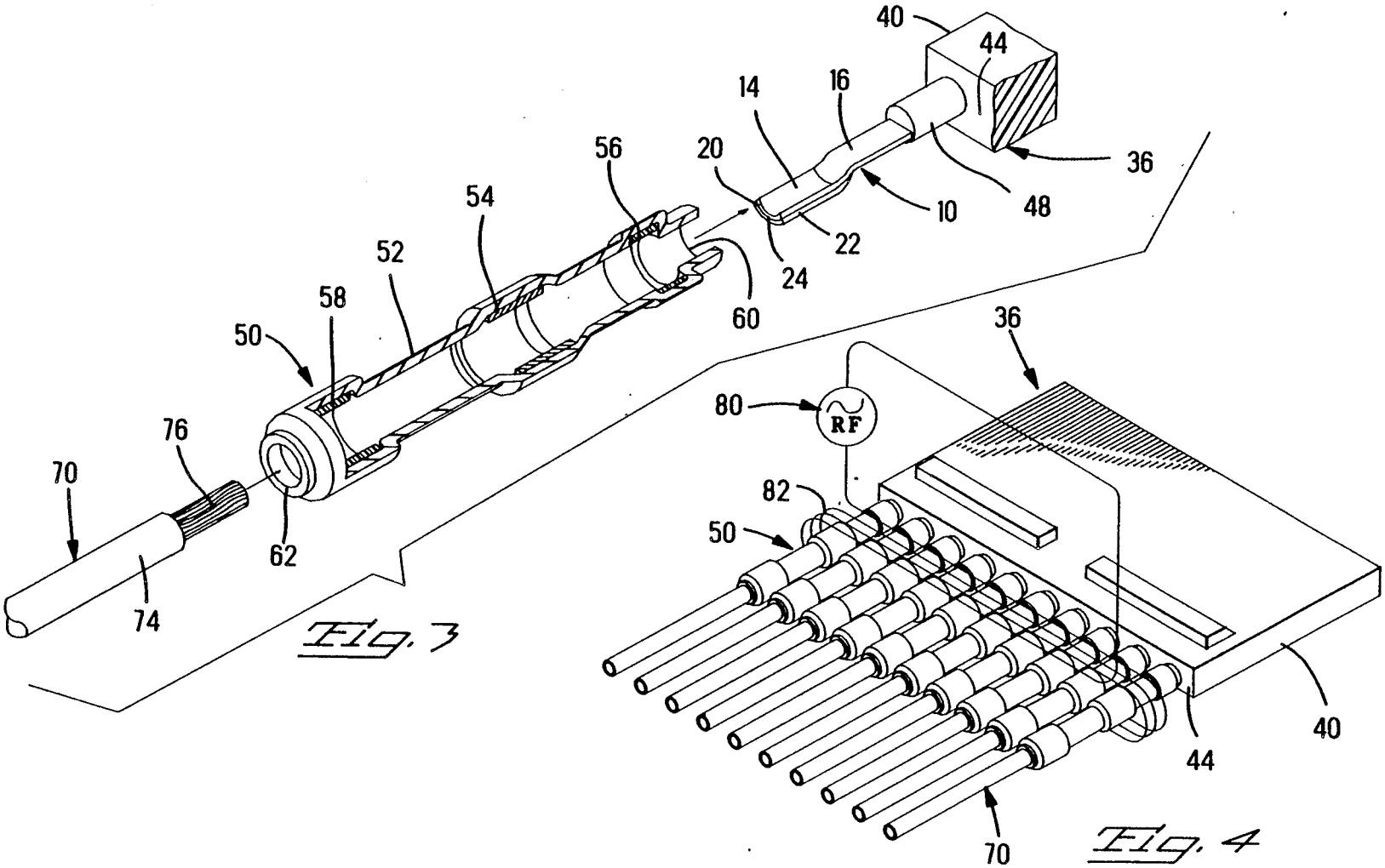
FIG. 3 is an enlarged perspective view of a single termination site showing a termination section, solder preform, sealant preforms and heat recoverable tubing lengths, with a layer of magnetic material clad to the solder tail.
FIG. 4 is a diagrammatic view showing the terminal subassembly and wires being terminated by a high frequency current generator.

In FIG. 4 the terminal subassembly and inserted wires have been placed and clamped within an apparatus 80 containing an inductance coil 82 closely surrounding the terminating region 32 A constant amplitude high frequency alternating current is generated by apparatus 80 such as a radio frequency signal at a frequency of 13.56 MHZ such as by an apparatus disclosed in U.S. Pat. No. 4,626,767. After a length of time such as about 30 seconds, the terminal-integral self-regulating temperature sources (FIG. 7) along the solder tails 14 have each achieved a certain temperature determined by the particular magnetic material of the sources, and the thermal energy therefrom melts the solder preforms 54, and then permeates the tubing lengths 52 and the sealant preforms 56, 58.

Figures 5, 6, 7, 8:
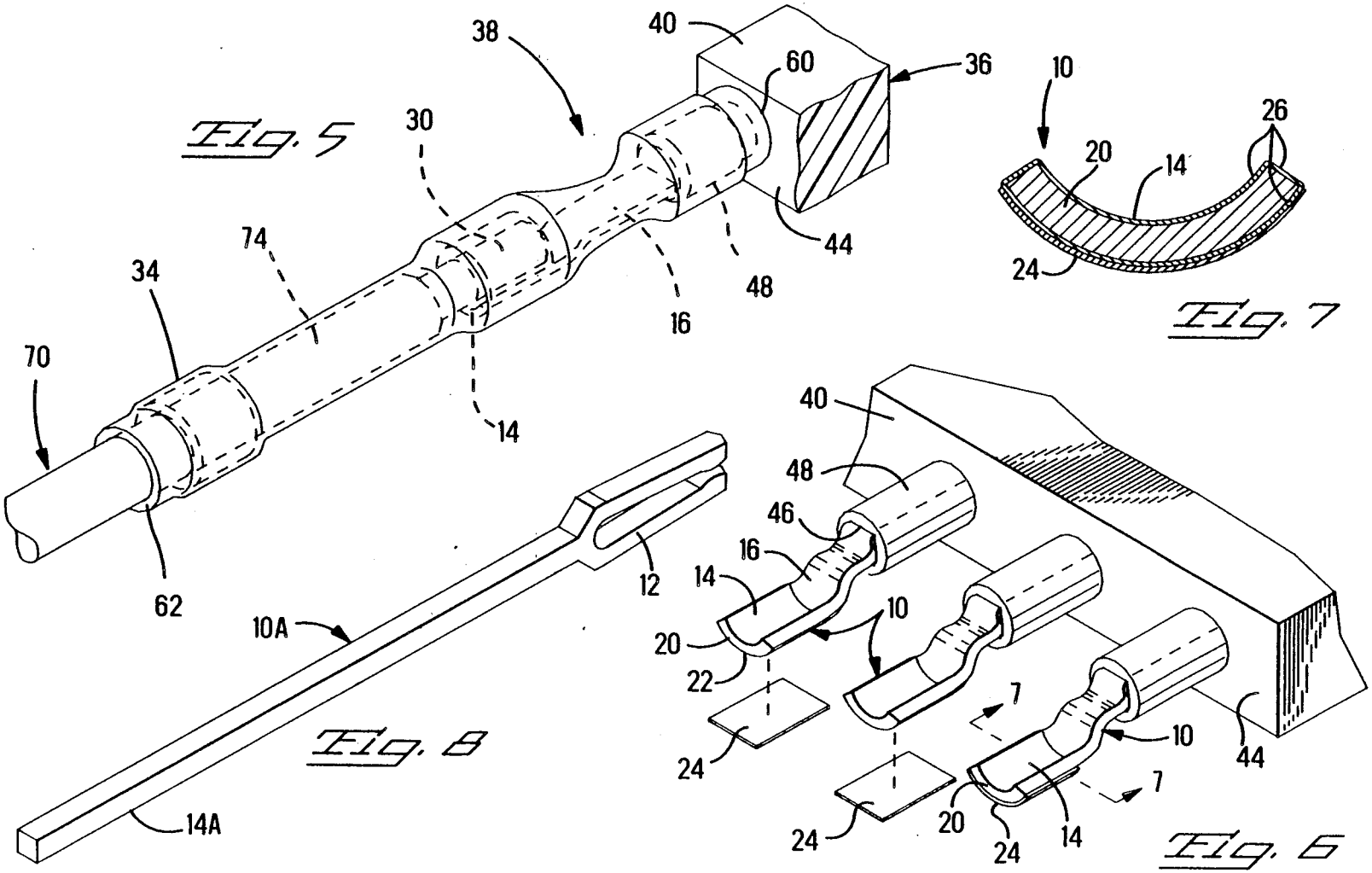

FIG. 5 shows a terminated and sealed connection after the solder has been melted by high frequency induction heating to form a solder joint termination 30 between wire end 78 and solder tail 14, fusible sealant preforms 56, 58 have melted and shrunk in diameter to bond to flange 48 and insulated wire end 74, and tubing 52 has shrunk to conform to the outer surfaces of the structures therewithin, and bonds to sealant preforms 56, 58 sealing the termination by tightly gripping about the insulated wire end 74 at trailing end 62 and the flange 48 at leading end 60, forming a seal 34.

Referring now to FIGS. 6 to 9B, terminal 10 can be made from a strip of stock metal such as brass or phosphor bronze or beryllium copper, for example, and can initially comprise the shape of a post 10A which is 0.025 inches square and having at its forward end a tuning-fork shaped socket contact section 12 while rearward end 14A is initially square in cross-section Terminal 10A may then be nickel plated, and the contact surfaces of socket contact section 12 may be gold plated if desired. Terminal 10A may then be inserted into a passageway 46 of housing 40 from forwardly thereof, with rearward end 14A extending through flange 48 and outwardly therefrom, as seen in FIG. 9A. In FIG. 9B rearward end 14A is struck by tooling of conventional forming means (not shown) to be shaped into a somewhat flattened structure oriented about 90° from the plane defined by the tines of the socket contact section. The thus-flattened structure is also formed having a shallow groove shape to define a metal layer 20 about 0.015 to 0.020 inches thick and having an outwardly facing surface 22. Intermediate section 16 is formed to have an offset just at the exit from passageway 46 of flange 48 so that the eventual wire 70 (FIG. 5) will extend rearwardly from solder tail 14 in alignment with flange 48. Intermediate section 16 is also enlarged to comprise a means for retaining the terminal from forward movement along passageway 46 while socket contact section 12 defines a stop against the rearward end of the enlarged forward passageway section Layer 20 is then preferably plated with tin-lead metal to define an enhanced solder-receptive surface. Then optionally, plated layer 20 may be cleaned by flux and further plated such as by known bath immersion techniques, with a coating 26 totaling (inclusive of the preplated layer) about 0.0003 inches thick of tin-antimony solder such as Sb-5 having 95% tin and 5% antimony for high temperature connector applications, followed by cleaning. Optionally tin-lead solder may be used, such as 93% tin/7% lead or 60% tin/40% lead.

Substrate 24 which defines the self-regulating temperature source can comprise a foil such as disclosed in U.S. patent application Ser. No. 07/375,787 filed June 30, 1989. The substrate can have a first layer of copper or copper alloy such as brass or phosphor bronze which has low resistance and minimal magnetic permeability, and a thin second layer of magnetic material such as a nickel-iron alloy like Alloy 42. Typically a roll cladding process may be used where an amount of the magnetic material is laid over the substrate, then subjected to high pressure and temperature which diffuses the two materials together at the boundary layer, but other processes such as plating or sputter depositing could be used. Optionally a substrate could be formed by plating a layer of nickel onto a layer of copper to a thickness preferably 1½ to 2 times the skin depth of nickel at the selected frequency of the high frequency current. A thin layer of dielectric coating material may be applied over the exposed surface of the magnetic material layer to inhibit oxidation, and/or optionally a thin layer of solder resist may be used to coat the exposed surface of the magnetic material layer. A coating of inert polyimide resin would provide solder resist properties to the exposed surface of the magnetic material layer, such as KAPTON polyimide (trademark of E. I duPont de Nemours and Company, Wilmington, Delaware).

Referring to FIGS. 10A and 10B, solder tail 14 of terminal 10 having a solder coating 26 therearound is placed in tooling of apparatus 100 for application thereonto of a substrate 24 of self-regulating temperature source foil at least having a layer of magnetic material. A platen 102 supports a strip 28 of substrate foil, which is held clamped thereagainst by clamp 104. Foil strip 28 may be for example 0.002 inches thick having a layer of copper alloy and a layer of magnetic material such as iron-nickel. Beneath platen 102, solder tail 14 (shown inverted) is supported by an anvil 106 having an upper surface 108 shaped to conform to the shallow channel of solder tail 14. A reciprocal-moving upper die 110 is urged downwardly through a corresponding apertures 112,114 in clamp 104 and platen 102 toward the outwardly facing surface 22 of layer 20 of solder tail 14, and has a correspondingly shaped convex surface 116 disposed between parallel cutting edges 118 As cutting edges 118 are pressed through clamped foil strip 28, a shape 24 of foil 28 is cut from the strip and simultaneously urged downwardly by convex surface 116 of die 110.

In FIG. 10B, die 110 holds foil shape 24 against the solder-coated surface 22 of solder tail layer 20, as die 110 is heated (or has been preheated) to a temperature sufficient to melt solder coating 26 to reflow, such as about 280° C. The solder of solder coating 26 should have a sufficiently high reflow temperature not to be reflowable by the thermal energy produced by the self-regulating temperature source when it achieves the selected temperature when actuated by the known-frequency current. When die 110 is retracted, the foil shape will remain on the solder tail surface 22 and will be soldered intimately thereto upon solidification of the molten solder material. It is preferred that the upwardly facing surface contain the magnetic material layer of the foil strip 28 and have coated thereon a conventional solder resist so that foil shape 24 will have defined an outwardly facing surface having solder resist material thereon such as a polyimide coating to facilitate proper eventual soldering of a wire end to solder tail 14. It may be desirable that the solder resist material also serve to inhibit oxidation of the magnetic material. Optionally solder may be added between an uncoated solder tail 14 and the foil layer 24 just prior to the stroke of die 110.

A similar terminating section for a terminal useful in surface mounting to a printed circuit conductive pad is disclosed in U.S. patent application Ser. No. 07/277,361 filed Nov. 29, 1988 and assigned to the assignee hereof.

An example of a process using the terminal-integral self-regulating temperature source of the present invention would be: providing an apparatus capable of providing a constant amplitude high frequency alternating current having frequency such as 13.56 MHz; selecting a solder preform having tin-lead solder with flux which melts at a nominal temperature of about 183° C. selecting heat recoverable tubing shrinkable at a nominal temperature of 175° C. and disposed around the solder preform; forming the solder tail having a layer of brass with a thickness of 0.020 inches and having soldered thereunder a thin layer of foil containing Alloy No. 42 and having a thickness of 0.002 inches and applying an RF current at 13.56 MHz thereto for 30 seconds. The integral self-regulating temperature source which comprises the solder tail will rise to a temperature of generally about 250° C., melt the solder, shrink and tackify the sealant preforms, and shrink the tubing Also, if solder preforms are selected having a melting temperature of about 240° C. such as Sb-5, a magnetic material may be used having a nominal Curie temperature of about 300° C. to 315° C.

Other variations may be made by skilled artisans to the present invention which are within the spirit of the invention and the scope of the claims.

What is claimed is:

1. An electrical terminal of the type including a conductor-terminating portion having a conductor-proximate surface and a conductor-remote surface, with the conductor-proximate surface adapted to facilitate solder termination to a conductive section of an electrical conductor means, the conductor-terminating portion being formed of a low resistance metal having minimal magnetic permeability, characterized in that:

said conductor-remote surface has joined thereto a substrate at least including a layer of magnetic material in a manner assuring good thermal conductivity therebetween, said magnetic material having high electrical resistance and high magnetic permeability, said layer having a thickness approximately equal to one skin depth of said magnetic material corresponding to a frequency of a source for generating a constant amplitude high frequency alternating current of known frequency, defining a self-regulating temperature source capable of being induced by the known-frequency current to generate thermal energy to attain and maintain a selected temperature; and said joint of said substrate and said conductor-remote surface being a solder joint of solder having a sufficiently high reflow temperature not to be reflowable by said self-regulating temperature source when actuated by said known-frequency current, whereby said electrical terminal includes an integral self-regulating temperature source defined by said conductor-terminating portion and said substrate soldered thereto to melt solder having a reflow temperature at least lower than said selected temperature to terminate a conductive section of the conductor means to the conductor-terminating portion.

2. An electrical terminal as set forth in claim 1 further characterized in that said substrate comprises an additional layer of another metal having low resistance and minimal magnetic permeability intimately affixed to said layer of magnetic material, and said substrate is soldered to said conductor-terminating portion with said additional layer adjacent said conductor-remote surface thereof.

3. An electrical terminal as set forth in claim 1 further characterized in that the solder tail-remote surface of said substrate includes thereon a coating of solder resist material.

4. An electrical terminal as set forth in claim 1 further characterized in that aid conductor-terminating portion is shaped into a shallow channel having said conductor-proximate surface along the bottom of said channel, to receive thereinto a wire end of an electrical conductor wire.

5. A method of making an electrical terminal of the type including a conductor-terminating portion having a conductor-proximate surface and a conductor-remote surface, with the conductor-proximate surface adapted to facilitate solder termination to a conductor section of an electrical conductor means, the conductor-terminating portion being formed of a low resistance metal having minimal magnetic permeability, comprising the steps of:

selecting a member defining a substrate at least including a layer of magnetic material, said magnetic material having high electrical resistance and high magnetic permeability, said layer having a thickness approximately equal to one skin depth of said magnetic material corresponding to a frequency of a source for generating a constant amplitude high frequency alternating current of know frequency, said substrate defining, at least after being joined to a conductor-remote surface of said conductor-terminating portion, a self-regulating temperature source capable of being induced by said known-frequency current to generate thermal energy to attain and maintain a selected temperature; and joining said substrate to said conductor-terminating portion in a manner assuring good thermal conductivity therebetween by soldering using solder having a sufficiently high reflow temperature not to be reflowable by said self-regulating source when actuated by said known-frequency current, whereby said self-regulating temperature source is adapted to melt solder having a reflow temperature at least lower than said selected temperature to terminate a conductor section of the electrical conductor means to the conductor-terminating portion.

6. A method as set forth in claim 5 further comprising the steps of cutting said substrate from a continuous strip of material, urging and holding said cut substrate by die means intimately against said conductor-remote surface of said conductor-terminating region with solder material therebetween, and heating at least said substrate to reflow said solder, thereby soldering said substrate to said conductor-terminating portion.

* * * * *